US006422392B1

(12) United States Patent
Levy

(10) Patent No.: US 6,422,392 B1
(45) Date of Patent: Jul. 23, 2002

(54) AMMONIA REMOVAL FROM FLY ASH IN AN ACOUSTICALLY ENHANCED FLUIDIZED BED

(76) Inventor: Edward Kenneth Levy, 1030 Raymond Ave., Bethlehem, PA (US) 18018

( * ) Notice: Subject to any disclaimer, the term of this patent is extended or adjusted under 35 U.S.C. 154(b) by 0 days.

(21) Appl. No.: 09/541,962

(22) Filed: Apr. 4, 2000

Related U.S. Application Data

(63) Continuation-in-part of application No. 09/456,269, filed on Dec. 7, 1999, now abandoned, which is a continuation-in-part of application No. 08/834,540, filed on Mar. 4, 1997, now Pat. No. 5,996,808.

(60) Provisional application No. 60/012,835, filed on Mar. 5, 1996.

(51) Int. Cl.[7] ..... B07B 4/00

(52) U.S. Cl. ..... 209/11; 209/20; 209/474; 209/590; 95/45; 95/123

(58) Field of Search ..... 209/11, 20, 474, 209/475, 590; 95/45, 122, 123; 34/249

(56) References Cited

U.S. PATENT DOCUMENTS 4,233,275 A * 11/1980 Kimura et al. ..... 423/230
4,255,166 A * 3/1981 Gernand et al. ..... 34/249 X
4,474,629 A * 10/1984 York et al. ..... 149/109.6
5,996,808 A * 12/1999 Levy et al. ..... 209/474

* cited by examiner

*Primary Examiner*—Tuan N. Nguyen
(74) *Attorney, Agent, or Firm*—Law Offices of Royal W. Craig

(57) ABSTRACT

A process for removing ammonia from fly ash during processing on an inclined fluidized bed. The process begins by introducing a mixture of particulates having ammonia adsorbed therein into an inclined fluidized bed. Concurrently, a fluidizing gas is pre-heated and is also introduced into the fluidized bed. The mixture is then processed along the fluidized bed with the pre-heated fluidizing gas to achieve bubbling fluidization of the particles. This causes segregation by which a dense fraction settles downward and a light fraction rises upward in the bed. Ammonia in the particles is desorbed by the pre-heated fluidizing gas. The fluidizing gas is then scrubbed after the processing step to remove the desorbed ammonia. The process may also include the use of acoustic enhancement whereby an acoustic field is imposed on the fluidized bed to improve fluidization and segregation of the particles and to increase the efficacy of ammonia removal. In addition, a heat exchanger or electric heating elements immersed in the fluidized bed can be used to heat the ash to the temperatures needed to desorb ammonia from the ash. Furthermore, the energy efficiency of the process can be improved by recovering heat from the hot ash discharged from the fluidized bed and/or from the exhaust stream of hot fluidizing gas, for reuse during preheating steps. The improved process removes ammonia in a simple and efficient manner by preheating the fluidizing gas of the inclined bed to temperatures of 300 to 500° F., and using this preheated gas to drive off any adsorbed ammonia.

7 Claims, 3 Drawing Sheets

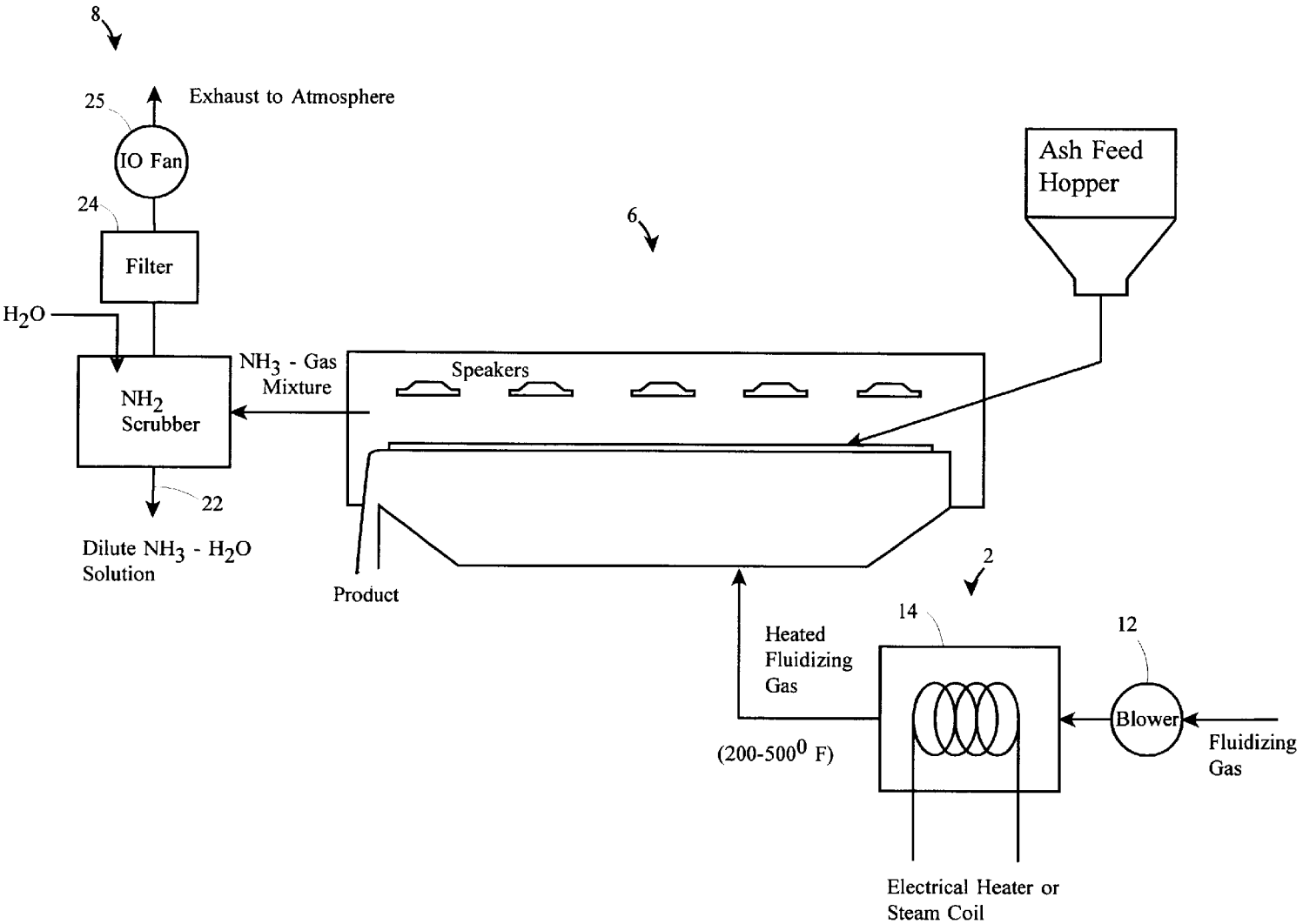
FIG. 2: Sketch of Inclined Fluidized bed Used for Stripping Ammonia From Fly Ash

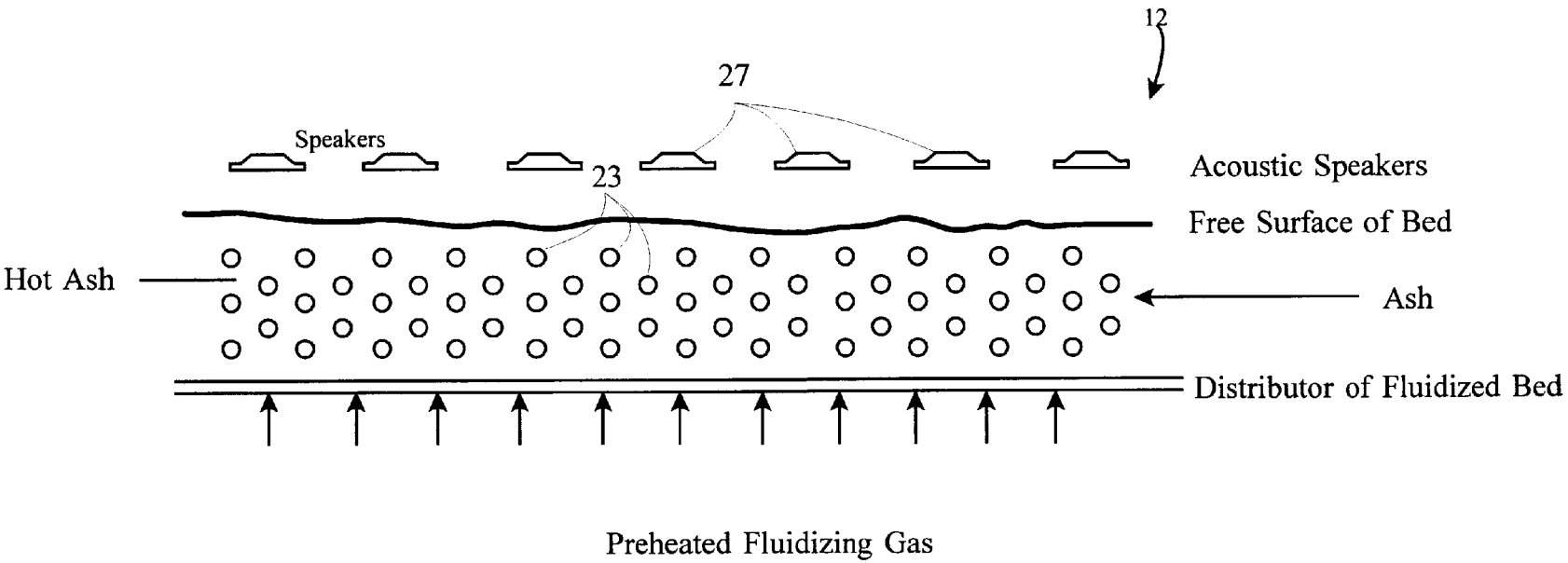
FIG. 3: Sketch of System Using Electric Heating Elements or a Heat Exchanger Immersed in the Inclined Fluidized Bed to heat the Ash to the Temperatures at which Ammonia Desorption Occurs

AMMONIA REMOVAL FROM FLY ASH IN AN ACOUSTICALLY ENHANCED FLUIDIZED BED

CROSS-REFERENCE TO RELATED APPLICATIONS

The present application is a continuation-in-part of Ser. No. 09/456,269 filed Dec. 7, 1999 (abandoned), which is a continuation-in-part of Ser. No. 08/834,540 filed Mar. 4, 1997 (U.S. Pat. No. 5,996,808), for which priority is derived from provisional application No. 60/012,835, filed Mar. 5, 1996.

FIELD OF THE INVENTION

The present invention relates to the removal of adsorbed $NH_3$ during the process for separating different types of particulates, e.g., carbon from fly ash, using an improved inclined fluidized bed approach and acoustic enhancement.

BACKGROUND OF THE INVENTION

In a typical pulverized coal power plant, 80 percent of the ash is carried from the boiler as fly ash and is removed from the flue gas in an electrostatic precipitator, fabric filter or wet scrubber. As a result, U.S. electric utilities spend about $1 billion annually to dispose of most of the 75 million tons of ash removed from their pulverized coal burning plants. For this reason, there has been worldwide activity for many years on the development of ways of utilizing fly ash as an alternative to ash disposal. One of the high volume end uses which has found commercial acceptance is the substitution of fly ash for some of the cement used in concrete.

However, in addition to containing a variety of inert minerals, fly ash may also contain undesirable amounts of unburned carbon. High levels of unburned carbon in fly ash are common with bituminous coals burned in both corner-fired and wall-fired pulverized coal boilers. High levels of unburned coal are even more severe when low NOx burners are used for NOx control. Many utilities who wish to sell their fly ash for use in concrete must reduce these levels of fly ash carbon at high cost. Although over 56 million tons of cement were used to produce concrete in the U.S. in 1991, only approximately 7 million tons of fly ash went into U.S. concrete due to the cost of carbon removal.

One of the standard laboratory tests for the amount of unburned carbon in fly ash is the so-called loss-on-ignition test (LOI). In this disclosure, the terms LOI and unburned carbon will be used interchangeably. The amount of LOI is influenced by the size distribution of coal leaving the coal pulverizers, the combustion conditions in the furnace and the design of he furnace and the burners. For utility boilers burning bituminous coal, utilities have traditionally tried to maintain the LOI in the fly ash to below 6 weight percent. This is done to prevent excessively large losses in boiler efficiency. But for many boilers, this has not been an easy goal to meet. For those utilities who wish to sell their fly ash for use in concrete, it is necessary to maintain the fly ash carbon to even lower levels, with limits of 3 to 5 percent carbon content usually imposed by the concrete manufacturers. Utilities are now installing low NOx burners on their boilers for NOx control. However, as described above, this escalates the problem of fly ash LOI. Test data resulting from recent low NOx installations show that operating a boiler with low NOx burners invariably results in an increase in fly ash LOI, sometimes two-fold in extent.

Thus, there remains a commercial need for an industrial process which beneficiates fly ash in an economical manner, thus making it more amenable to reuse in concrete and otherwise. The problem lies in the separation and removal of carbon from fly ash.

An improved continuous process for cleaning coal is disclosed in U.S. Pat. No. 5,197,398. This process, referred to as D-CoP, relies on an inclined fluidized bed (shown in FIG. 4 herein). This type of bed resembles a long, nearly horizontal, table, with fluidizing air passing vertically upward through a distributor causing bubbling to occur in the bed material. The coal and magnetite, which are added to the bed at one end via coal feed and magnetite feed, flow along the length of the bed, and as they do so, the pyrite and other minerals sink downward through the layer of particles. The clean coal with some magnetite is then separated from the coal refuse at the discharge end. The D-CoP process relies on the use of a bubbling fluidized bed to achieve separation of particles based on differences in density. The bubbles, which are formed at the distributor located at the bottom of the bed, act as pumps. They carry material upward from the bottom of the bed, and at the same time, provide a mechanism by which relatively dense particles near the top of the bed can move downward. Thus, the ability to achieve stable bubbling fluidization is central to the good separation efficiencies which are achieved by D-CoP when used for cleaning coal.

In order to apply this fluidized bed approach to fly ash, it is necessary to achieve good bubbling fluidization. However, fly ash particles are relatively small in size, with mean particle diameters which are typically less than 15 to 20 microns. Particles in this size range do not fluidize well in the bubbling mode. Instead, the particles tend to clump together, causing an unsteady slugging type of fluidization. A solution to this is described in U.S. Pat. No. 5,996,808 to Levy et al., which discloses a process for separating different types of particulates, e.g., carbon from fly ash, using an improved inclined fluidized bed approach with acoustic enhancement. According to the '808 patent, the dramatic effect of high intensity sound on bubbling with particulates such as fly ash enhances the beneficiation process. The sound affects characteristics such as bubble size distribution, shape, and wake configuration and bubble frequency, and it agitates the bed material to disrupt the interparticle forces. This promotes more uniform and consistent bubbling in the bed and thus enhances the segregation processes in the bed which are needed to achieve efficient separation of carbon. FIG. 1 is an illustration from the '808 patent showing how a loudspeaker 270 may be oriented with respect to the fluidized bed to produce the requisite acoustic excitation. The speaker(s) 270 may be any conventional loudspeaker(s) capable of generating the requisite Sound Pressure Level (SPL) in dB and frequencies (Hz). The speaker(s) 270 should be mounted above the bed and are preferably operated at power levels which generate values of SPL in excess of 140 dB at the free surface of the fluidized bed, and at frequencies of approximately 90 Hz (although this may vary).

In the enhanced process, ammonia ($NH_3$) is present in fly ash from some power plants due to $NH_3$ injection for $NO_x$ control or for conditioning the flue gas to improve electrostatic precipitator performance. The presence of $NH_3$ on the ash can create a safety hazard for workers who came in contact with the ash and can restrict use of ash in concrete production and other applications. It would be greatly advantageous to further supplement the process for separating carbon from fly ash during the enhanced fluidized bed approach with acoustic enhancement as described in U.S. Pat. No. 5,996,808 to Levy et al. to also remove ammonia ($NH_3$).

SUMMARY OF THE INVENTION

In accordance with the above, it is an object of the present invention to provide an improved industrial process for removing ammonia from fly ash during the use of an enhanced fluidized bed with acoustic enhancement as described in U.S. Pat. No. 5,996,808 to Levy et al., thereby making the fly ash and the carbon removal process safer for the production of concrete, etc.

It is another object to remove ammonia as described above in a simple and efficient manner by preheating the fluidizing air of the inclined bed to temperatures of 300 to 500° F., and using this preheated air to drive off any adsorbed ammonia.

It is a further object to present a flexible ammonia stripping application as described above that can be employed independently of the carbon removal such that the entire inclined bed can be dedicated to the ammonia removal or, alternatively, the processes can be integrated such that ammonia removal is accomplished in a first stage and carbon separation in a second stage of processing.

The above and other objects and advantages of the invention will become more readily apparent on examination of the following description, including the drawings, in which like reference numerals refer to like parts. Generally, the improvement disclosed herein is a process for removing ammonia from fly ash during processing on an inclined fluidized bed. The process begins by introducing a mixture of particulates having ammonia adsorbed therein into an inclined fluidized bed. Concurrently, a fluidizing gas is pre-heated and is also introduced into the fluidized bed. The mixture is then processed along the fluidized bed with the pre-heated fluidizing gas to achieve bubbling fluidization of the particles. This causes segregation by which a dense fraction settles downward and a light fraction rises upward in the bed. Ammonia in the particles is desorbed by the pre-heated fluidizing gas. The fluidizing gas is then scrubbed after the processing step to remove the desorbed ammonia. The process may also include the use of acoustic enhancement whereby an acoustic field is imposed on the fluidized bed to improve fluidization and segregation of the particles and to increase the efficacy of ammonia removal.

In addition, a heat exchanger or electric heating elements immersed in the fluidized bed can be used to heat the ash to the temperatures needed to desorb ammonia from the ash. Furthermore, the energy efficiency of the process can be improved by recovering heat from the hot ash discharged from the fluidized bed and/or from the exhaust stream of hot fluidizing gas, for reuse during preheating steps.

BRIEF DESCRIPTION OF DRAWINGS

FIG. 2 illustrates an acoustically-enhanced inclined fluidized bed for continuous removal of carbon from fly ash with a pre-heating system 2 for stripping ammonia from fly ash according to the present invention.

FIG. 3 illustrates an acoustically-enhanced inclined fluidized bed with electric heating elements or a heat exchanger immersed in the bed for heating the ash to the temperature at which ammonia desorption occurs.

DETAILED DESCRIPTION OF THE PREFERRED EMBODIMENTS

Figure 1:
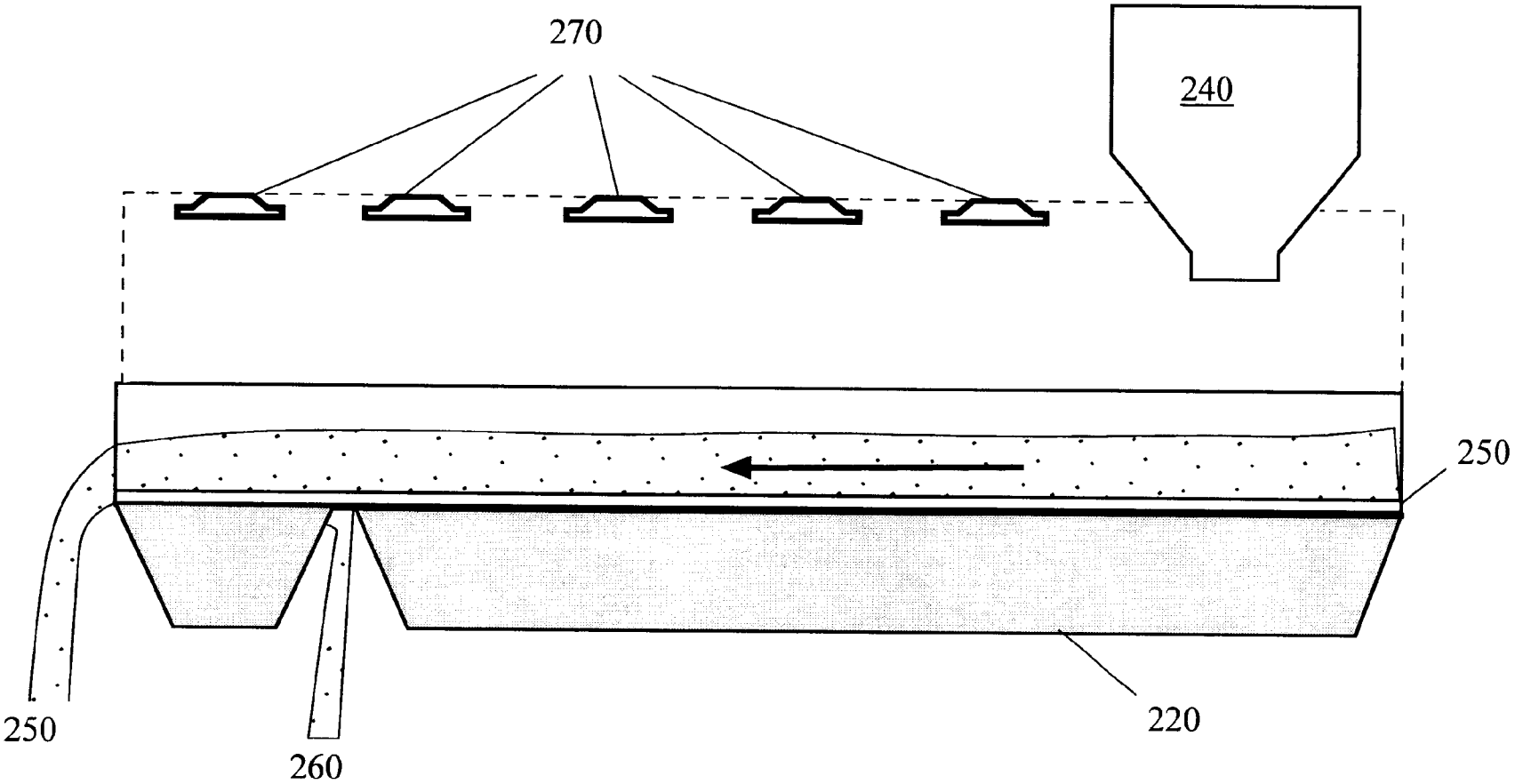
FIG. 1 is an illustration from U.S. Pat. No. 5,996,808 to Levy et al. showing how a loudspeaker 270 may be oriented with respect to a fluidized bed to produce acoustic excitation.

Generally, fly ash is fed to an inclined fluidized bed at one end and two streams are removed at the other end, one of which is rich in unburned carbon, the other containing relatively small concentrations of unburned carbon. Fly ash has a wide size distribution. In order to achieve a good separation of carbon from the inert parts of the fly ash, in some cases it will be necessary to separate the fly ash into two or more parts by size. This may be accomplished either by sieving or use of an aerodynamic classifier. Either pure ash can be fed to the bed for processing, or ash and magnetite or some other material can be fed to enhance separation (as is done for coal beneficiation). The ability to achieve stable bubbling fluidization is central to good separation efficiencies when cleaning fly ash.

U.S. Pat. No. 5,996,808 to Levy et al., the specification of which is herein incorporated by reference, discloses one or more speaker(s) mounted above the bed that are operated at power levels which generate values of SPL in excess of 140 dB at the free surface of the fluidized bed. Sound frequencies of approximately 90 Hz are suitable, though the operational parameters may very somewhat. As the fly ash flows along the length of the bed, operation of the speakers enhances segregation of the high and low LOI fractions.

It has more recently been found that ammonia ($NH_3$) is present in fly ash from some power plants due to $NH_3$ injection for $NO_x$ control or for conditioning the flue gas to improve electrostatic precipitator performance. The presence of $NH_3$ on the ash can create a safety hazard for workers who came in contact with the ash. High $NH_3$ levels can also prevent the use of such fly ash in concrete and other products. In accordance with the present invention, the carbon removal process is further supplemented to also remove ammonia ($NH_3$).

FIG. 2 illustrates an acoustically-enhanced inclined fluidized bed 6 for continuous removal of carbon from fly ash with a pre-heating system 2 for stripping ammonia from fly ash according to the present invention. The pre-heating system 2 includes a conventional blower 12 (or fan) for drawing in the fluidizing gas. Blower 12 is in fluid connection with a heating element 14 for pre-heating the fluidizing gas. The heating element 14 may be a conventional electrical heater, steam coil, or other suitable source of thermal energy. Heating element 14 preferably heats the gas to within the range of temperatures of 300 to 500° F. The fluidized bed chamber is also heated and insulated to maintain the inlet plenum, distributor and walls of the bed at the desired operating temperature. Thus, room temperature ash is fed to the bed 6 and is heated to the desired temperature as it contacts the preheated fluidizing gas. Alternatively, the ash may be heated to temperatures above room temperature before being fed to the bed 6.

Loud speakers 27 are positioned above the bed such that the sound is directed downward onto the free surface of the fluidized ash. Experiments have shown that the presence of the acoustic field is needed to achieving bubbling fluidization. Since the bubbling helps to promote gas-solids contacting, the use of acoustics with the preheated fluidizing gas also improves the efficiency of the $NH_3$ stripping process. Thus, acoustic enhancement will be needed for some ashes while the process can be operated without acoustics for others.

The entire fluidized bed chamber is preferably enclosed to prevent leakage of $NH_3$ to the atmosphere. It is also noteworthy that in many cases the use of pre-heated gas for fluidization of the ash will also cause sulfuric acid vapor to be removed from the ash.

The mixture of ammonia, sulfuric acid and fluidizing gas that is discharged from the bed needs to be treated for removal of the ammonia and sulfuric acid prior to discharge of the fluidizing gas to the atmosphere. For this, a scrubbing system 8 is attached to the output end of the acoustically-enhanced inclined fluidized bed 6 to remove the desorbed ammonia from the pre-heated fluidizing gas. The scrubbing system 8, shown in FIG. 2, includes an $NH_3$ scrubber 18 connected directly to the output end of the fluidized bed 6. A number of commercial $NH_3$ scrubbers are well-suited for this purpose. Alternatively, a conventional dessicant-type adsorber can be used instead of a liquid scrubber to remove ammonia from the fluidizing gas. The scrubbed fluidizing gas is exhausted to the atmosphere through a filter 24 with help from an upstream exhaust fan 25. Filter 24 is preferably a fabric filter for removing particles from the exhaust stream.

Ash, at room temperature, can be fed to the inclined bed, or, if preferred, the ash can be heated to temperatures above room temperature before being fed to the bed. In some cases, it is more cost effective to heat the ash with electric heating elements or a heat exchanger immersed in the inclined fluidized bed.

FIG. 3 shows an acoustically-enhanced inclined fluidized bed 12 with an in-bed heating system for continuous removal of $NH_3$ from fly ash. The in-bed heating system here comprises an in-bed heat exchanger with heat exchange tubes 23 immersed in the bed for heating the ash to the temperature at which ammonia desorption occurs. As an alternative to the heat exchanger, an electric heater with resistive heating elements is also well-suited. Given the arrangement as in FIG. 3, the ash is heated to the temperature required to remove ammonia through a combination of heat from the preheated fluidizing gas and heat transferred to the ash from the heat exchanger tubes. As before, loud speakers 27 are positioned above the bed such that the sound is directed downward onto the free surface of the fluidized ash.

To improve the energy efficiency of the process, heat can be recovered from the hot ash discharged from the fluidized bed of FIG. 3, and additionally, from the exhaust stream of hot fluidizing gas. This can also be accomplished in both cases using conventional heat exchangers.

Having now fully set forth a detailed example and certain modifications incorporating the concept underlying the present invention, various other modifications will obviously occur to those skilled in the art upon becoming familiar with said underlying concept. It is to be understood, therefore, that within the scope of the appended claims, the invention may be practiced otherwise than as specifically set forth herein.

I claim:

1. A process for removing ammonia from fly ash during processing on an inclined fluidized bed, including the steps of:

introducing a mixture of particulates having ammonia adsorbed therein into an inclined fluidized bed;

pre-heating a fluidizing gas;

introducing said pre-heated fluidizing gas into said fluidized bed;

processing said mixture along said fluidized bed with said pre-heated fluidizing gas to achieve bubbling fluidization of said particles and thereby cause segregation by which a dense fraction settles downward and a light fraction rises upward in said bed, and ammonia adsorbed in said particles is desorbed by said pre-heated fluidizing gas; and scrubbing the fluidizing gas after said processing step to remove desorbed ammonia there from.

2. The process according to claim 1, wherein said step of processing said mixture along said fluidized bed includes acoustic enhancement whereby an acoustic field is imposed on said fluidized bed to improve fluidization and segregation of said particles and to increase the efficacy of said ammonia desorption step.

3. The process according to claim 1, further comprising heating said mixture to a temperature in a range of between 300–500 degrees Fahrenheit during said processing step using heating elements immersed therein to desorb ammonia therefrom.

4. The process according to claim 3, wherein said immersed heating elements comprise heat exchanger tubes.

5. The process according to claim 3, wherein said immersed heating elements comprise electric heating elements.

6. The process according to claim 3, further comprising recovering heat from said heated and processed particles after ammonia desorption for reuse.

7. The process according to claim 3, further comprising recovering heat from said fluidizing gas after said processing step for reuse.

* * * * *